United States Patent [19]

Deike

[11] 4,021,977

[45] May 10, 1977

[54] REUSABLE YIELDING POST SUPPORTS

[75] Inventor: Robert F. Deike, Cheyenne, Wyo.

[73] Assignee: Foresight Industries, Cheyenne, Wyo.

[22] Filed: Mar. 19, 1976

[21] Appl. No.: 668,699

[52] U.S. Cl. ..... 52/98; 52/298

[51] Int. Cl.[2] ..... F16B 31/00

[58] Field of Search ..... 52/153, 154, 155, 98, 52/170, 296, 298; 404/10; 248/158, 156; 40/125 N, 125 R; 403/2

[56] References Cited

UNITED STATES PATENTS

| | | | |
|---|---|---|---|
| 2,227,553 | 1/1941 | Paque | 52/153 |
| 3,011,597 | 12/1961 | Galloway | 52/156 |
| 3,066,769 | 12/1962 | Pasquale | 52/153 |
| 3,349,531 | 10/1967 | Watson | 52/296 |

*Primary Examiner*—John E. Murtagh

*Attorney, Agent, or Firm*—Hill, Gross, Simpson, Van Santen, Steadman, Chiara & Simpson

[57] ABSTRACT

Posts, such as roadside delineators and sign supports are mounted upright from the ground by tubular anchors driven into the ground from their leading ends and having fins on their trailing ends embedded in the ground adjacent the surface thereof. A break-away support tube is secured in the tubular anchor to extend upright therefrom into a rigid but yieldable plastic tube with an elastic memory. The plastic tube carries a reflector, a sign, or the like at a level above ground which will attract the attention of drivers of vehicles on the roadway. The break-away tube is pierced at ground level just above the ground anchor so that when the plastic post is struck by a vehicle, the break-away tube will fracture at ground level permitting the plastic post to be forced to the ground without flying loose from the ground anchor and without springing back to damage the vehicle. The tubular ground anchor can receive an extension tube driven into the ground ahead of the leading end thereof to provide additional anchoring capacity in light soil ground conditions. The lower end of the break-away tube is wedged or clamped in the tubular ground anchor and the lower end of the plastic post is wedged or clamped on the break-away tube. When the break-away tube is fractured by vehicle impact, the entire assembly is reusable to reinstall the post in its upright position by discarding the section of the break-away tube below the fractured level and using the remaining tube length in the anchor and post. If the plastic tube has been bent or indented by the impact blow from the vehicle, it will soon recover its original straight tubular shape due to the elastic memory of the plastic. A new hole is then pierced in the break-away tube at ground level to form another fracture zone for accommodating another impact blow from oncoming traffic.

20 Claims, 13 Drawing Figures

REUSABLE YIELDING POST SUPPORTS

FIELD OF THE INVENTION

This invention relates to safety anchor systems for posts and the like and particularly deals with ground anchor systems for roadside posts which will fracture at ground level when impacted by a vehicle without permitting the post to fly loose or spring back and wherein the components are reusable at the post site to reinstall the post in its original upright position.

DESCRIPTION OF THE PRIOR ART

A load carrying earth anchor having vertical vanes and extensible tentacles is disclosed and claimed in my prior U.S. Pat. No. 3,680,274, issued Aug. 1, 1972. This anchor is especially suitable for heavy duty usage but is costly to produce and does not have the break-away capacity of this invention.

SUMMARY OF THE INVENTION

According to this invention, a tubular ground anchor is provided with a leading end having an internal abutment or striking face to be engaged by a driving ram and radiating fins or flukes on its trailing end to be embedded just below the surface of the ground. The leading end may have an extension tube attached thereto or slidable therethrough to provide additional ground support in loose sand or gravel or other light soil conditions. The fins or flukes stabilize the driven tube against tilting in the ground and are conveniently formed from a single strip of metal bent to provide three radiating fins straddling the tube and welded thereto. The tube provides a socket barrel for a break-away tube or stanchion which is wedge locked or clamped at a desired depth in the barrel to project above ground level forming a support for a plastic tubular post which is clamped or wedged to the break-away tube or stanchion. A hole is pierced into the stanchion or breakaway tube, at ground level, preferably facing oncoming traffic or if desired three such holes can be pierced 120 degrees apart in the break-away tube at ground level. When the plastic post is struck by a vehicle, the stanchion tube will fracture at the level of the pierced hole permitting the post to fall to the ground without springing back after impact but the stanchion sections will remain connected to prevent the post from flying loose.

A fractured post assembly is easily reassembled to again mount the post in upright position by removing the stanchion from the socket barrel, discarding the length of the stanchion below the fractured level, reinserting the remaining length of stanchion tube into the barrel and again securing the stanchion tube to the ground anchor barrel and the post to the stanchion tube. The flukes or fins of the ground anchor hold the socket barrel in its initial upright position, but in the event the ground anchor is tilted by the impact, it can easily be pulled back to an upright position by dropping an elongated rod into the barrel and pulling it to an upright position.

It is then an object of this invention to provide a post anchor system which will fracture at ground level when impacted without permitting the post to fly loose or spring back and which is easily reassembled with the original components to again mount the post in upright position after fracture.

Another object of the invention is to provide a reusable yielding post anchor system for roadside delineators, signposts and the like which will fracture but not sever when impacted by a vehicle and which is easily and quickly reinstalled to its original upright position after fracture.

Another object of this invention is to provide a ground anchor with sheet metal fins embracing a tube and providing a support for a wedge.

Another object of the invention is to provide a ground anchor with a tubular barrel adapted to be driven into the ground from its leading end and held against tilting in the ground by flukes at its trailing end and adapted to be clamped to a tube inserted therein for carrying a hollow post telescoped over the tube.

A further object of the invention is to provide a roadside post assembly which yields upon impact and is reusable after impact without requiring replacement components.

A further object of the invention is to provide a delineator post assembly including a plastic tube having an elastic memory carrying a reflector at the top end thereof and telescoped over a break-away tube which is telescoped in a ground anchor.

A specific object of the invention is to provide an inexpensive fluke equipped tubular ground anchor having the flukes composed of a single sheet of metal bent to embrace a tube.

Another object of the invention is to provide a ground anchor having a central barrel with a leading end adapted to be impacted from inside the barrel to be driven in the ground and a trailing end having radiating fins holding the barrel upright in the ground together with clamping means above the ground for securing a post carrier in upright position.

Another specific object of the invention is to provide a yielding post assembly including a plastic tube telescoped over a break-away tube which in turn is telescoped into the barrel of a ground anchor.

Other and further objects of this invention will become apparent to those skilled in this art from the following detailed description of the annexed sheets of drawings which show several embodiments of this invention.

DESCRIPTION OF THE PREFERRED EMBODIMENTS

Figures 1, 2, 3, 4, 5, 6, 7:
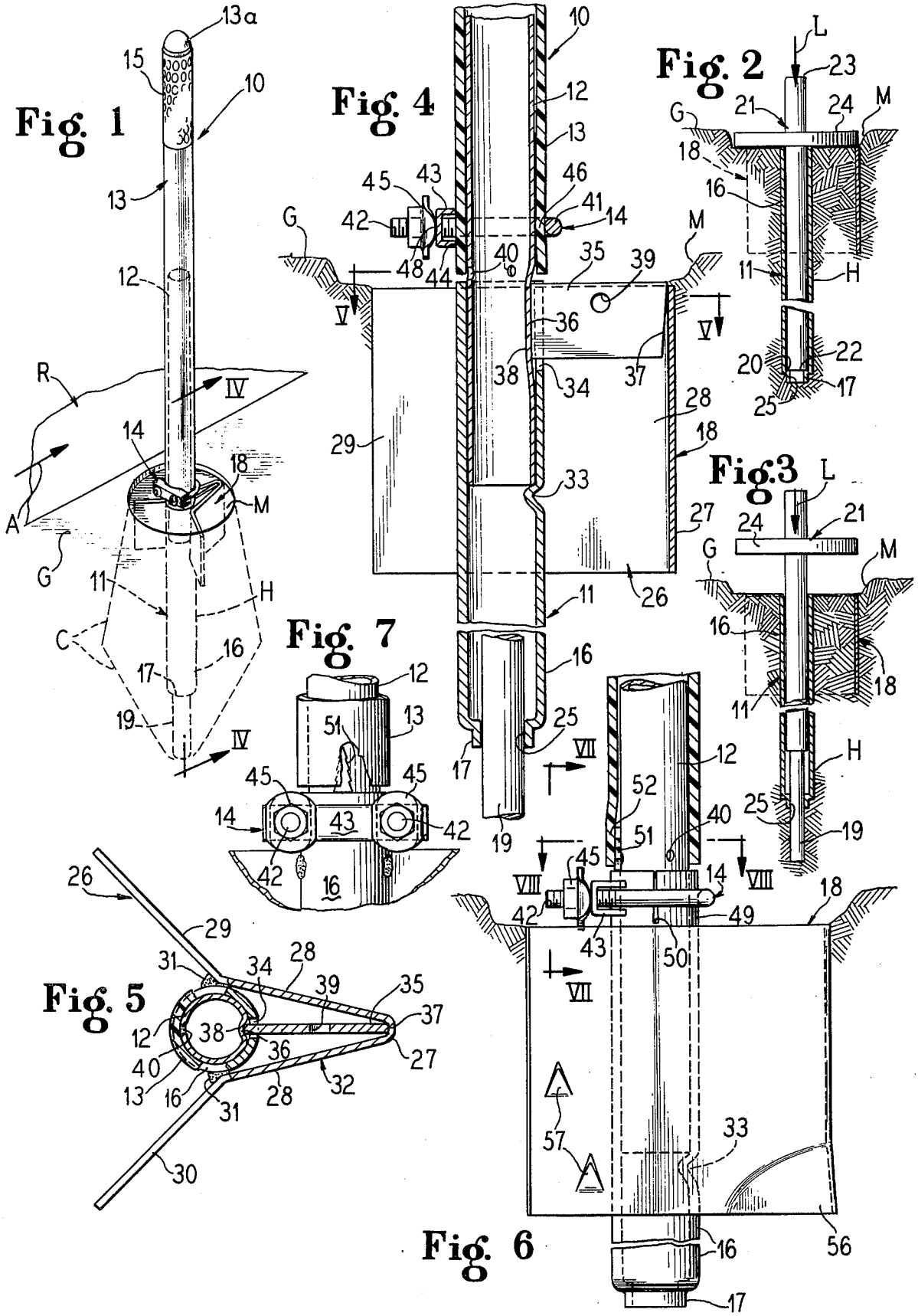
FIG. 1 is a perspective view of a highway delineator post anchored in the ground along a highway in accordance with the reusable yielding support system of this invention.
FIG. 2 is a diagrammatic side elevational view, with parts in cross-section illustrating the manner in which the anchor of the post assembly is driven in the ground.
FIG. 3 is a view similar to FIG. 2 but showing the manner in which the ground anchor may be further stabilized by an extension member.
FIG. 4 is a fragmentary longitudinal cross-sectional view taken along the lines IV—IV of FIG. 1.
FIG. 5 is a transverse cross-sectional view taken along the lines V—V of FIG. 4.
FIG. 6 is a fragmentary side elevational view showing a quick disconnect clamp arrangement for the ground anchor of FIGS. 1–5.
FIG. 7 is an elevational view taken along the lines VII—VII of FIG. 6.

The post assembly 10 shown in FIG. 1 is composed of a ground anchor 11, a break-away or stanchion tube 12, a post tube 13 and a clamp 14. The anchor 11 is driven in the ground G alongside a road or highway R for traffic traveling in the direction of the arrow A.

The tube 13 has reflector tape 15 wrapped around the upper end thereof at a level to be illuminated by the headlights of vehicles traveling in the direction of the arrow A on the highway R. Preferably the post 13 is about 4 to 5 feet in length to carry the reflector tape at a good visible level above the roadway and has its top end closed by a cap 13*a*.

The ground anchor 11 has a tubular metal barrel 16 with a leading driving end 17 and a trailing end with fins or flukes 18 projecting radially therefrom. The anchor is driven into to the ground G to a depth embedding the fins or flukes 18 in the ground so that their upper edges are just below ground level. An extension tube 19 projects from the leading end 17 of the anchor barrel 16.

As shown in FIG. 2, the anchor is driven into the ground G from its leading end 17 which is reduced in diameter to provide an impact shoulder 20 inside the tubular barrel immediately adjacent the driving end 17. This shoulder is pressed or impacted by a driving ram 21 which has a flat leading end 22 engaging the shoulder 20 and a trailing end 23 impacted or pressed by a hammer load L. A collor 22 surrounds the driving tool or ram 21 and overlies the trailing end of the barrel 11 to pack the ground around the barrel and form a mouth M surrounding the hole H formed in the ground by the barrel 16. A compacted area C of ground thus surrounds the anchor 11 as shown in FIG. 1.

When the driving tool has driven the anchor 11 into the ground C to a position where the fins or flukes 18 are submerged in the ground, if further anchoring stability is desired for the anchor 11 because of light or loose soil conditions of the ground G, the driving ram 21 may be temporarily removed from the barrel 16 and the extension tube 19 inserted in the aperture 25 of the driving end of the barrel, preferably having a sliding fit therewith whereupon the ram is then impacted against the top end of the tube 19 as shown in FIG. 3 to drive the tube to a desired depth in the ground and provide an extension leg for the ground anchor 11.

It will be understood that the extension tube 19 is not needed unless the roadside ground is loosely packed even after it is compacted to form the zone C surrounding the ground anchor 11.

As shown in FIGS. 4 to 10, the fns or flukes 18 are formed from a single strip of metal 26 which is folded midway of its length as shown at 27 to provide a pair of diverging legs 28 in spaced opposed relation embracing the barrel 16 and then bent outwardly to provide widely divergent legs 29 and 30 projecting beyond the barrel 16. The legs 28 and the adjoining inner ends of the legs 29 and 30 are welded to the barrel 16 at the top and bottom ends thereof as shown at 31. The legs 28 form a first fluke or fin 32 cooperating with the legs 29 and 30 to provide three fins radiating from the barrel 16 in equally spaced relation being separated at angles of about 120°.

As shown in FIG. 4, the break-away or stanchion tube 12 is dropped into the upper end of the barrel 16 to rest on a dimple 33 pressed into the barrel above the bottom edge of the flukes 18. This tube 12 has a free sliding fit in the barrel and when resting on the dimple 33 projects from the ground anchor into the post tube 13.

As shown in FIGS. 4 and 5, the upper end of the barrel 16 has a longitudinal slot 34 extending from the top end thereof to a depth spaced above the dimple 33 and a metal wedge 35 has a vertical leading edge 36 projecting into this slot 34 against the tube 12 together with a tapered trailing edge 37 engaging the bight of the bent convergent end 27 of the legs 28 of the flukes 18. The wedge 35 is driven downwardly between the legs 28 causing the tapered rear edge 37 to wedge against the bight portion of the bent section 27 thereby forcing the leading end 36 into the tube 12 forming a depressed groove 38 and thereby fixedly locking the tube 12 to the barrel 16 of the ground anchor 11. The wedge 35 has a hole 39 intermediate its ends and near its top edge to receive a prying tool that can be rocked on the top end edge of one of the legs 28 to remove the wedge from the groove 38 and permit the tube 12 to be withdrawn from the barrel 16.

After the tube 12 is anchored in the barrel 11, a hole 40 is pierced therethrough at ground level in the side thereof facing oncoming traffic on the road R. If desired, several such holes can be formed in the tube 12, preferably three in number spaced 120 degrees apart. These holes form a fracture zone causing the tube 12 to break and bend over at ground level when the post 13 is struck by a vehicle.

The post 13 is telescoped over the upper end of the tube 12 and is secured to the tube by the clamp 14. As shown in FIG. 4 the clamp 14 is composed of a U-bolt 41 embracing the post 13 with threaded legs 42 extending through a bracket 43 of U-shaped cross-section and having top and bottom legs with arcuate inner edges 44 embracing the post 13 opposite the bight of the U-shaped bolt. Nuts 45 threaded on the legs 42 are bottomed on the bracket 43 to tighten the U-bolt 41 around the post 13 causing it to be deformed inwardly as shown at 46 and thereby tightly clamping the lower end of the post onto the tube 12 above the fracture zone provided by the hole 40.

Figure 10:
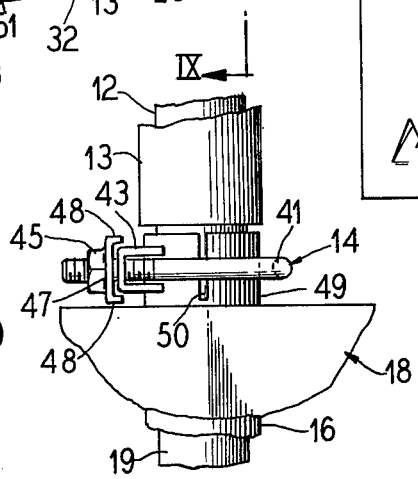
FIG. 10 is a fragmentary view similar to FIG. 6 but showing the clamp in its released position.

As better shown in FIGS. 4, 6, 8 and 10, the nuts 45 threaded on the bolt legs 42 have fixed collars 47 on their inner ends with a pair of spaced parallel curved flanges or ears 48 adapted to engage the outer bight portion of the U-shaped bracket 43 to tighten the clamp 14 or to straddle the bracket 43 as shown in FIG. 10 to loosen the U-bolt 41. Thus, a one-quarter turn of the nuts 45 from the position of FIGS. 4, 6 and 8 to the position of FIG. 10 will loosen the clamp 14.

Figure 8:
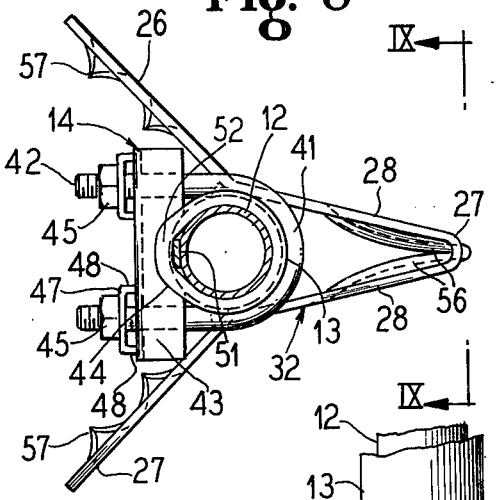
FIG. 8 is a transverse sectional view, taken along the lines VIII—VIII of FIG. 6.

The flanges 48 are spaced apart a sufficient distance to overlie the bracket 43 in the loosened position of the nut, but when rotated 90 degrees from the position of FIG. 10 to the position of FIG. 8, the inner edges of these flanges will engage the bracket face. These flanges are curved or rounded to merge into the portions of the collar between the flanges to ride upon the bight of the bracket 43.

Instead of terminating the upper end of the barrel 16 flush with the top edge of the flukes 18, and using the wedge 35 to lock the tube 12 to the barrel 16 and then using the clamp 14 to contract the lower end of the post 13 around the tube 12, all as shown in FIGS. 1 to 4, the barrel 16 can be provided with a longitudinally split projection 49 above the top of the flukes 18, receiving the clamp 14 therearound and the tube 12 therein as shown in FIGS. 5 to 10. When the clamp 14 is tightened, the slot 50 of this projected upper end portion 49 will be contracted to clamp the barrel to the tube 12 as illustrated in FIG. 6. In this arrangement the post 13 is secured to the tube 12 above the clamp 14 by a fir tree shaped wedge 51 resting on the upper edge of the projection 49 against the tube 12 so that when the post 13 is forced over the wedge 51, the post will deform as shown at 52 (FIG. 6) around the wedge and become tightly locked to the tube 12.

Figure 11:
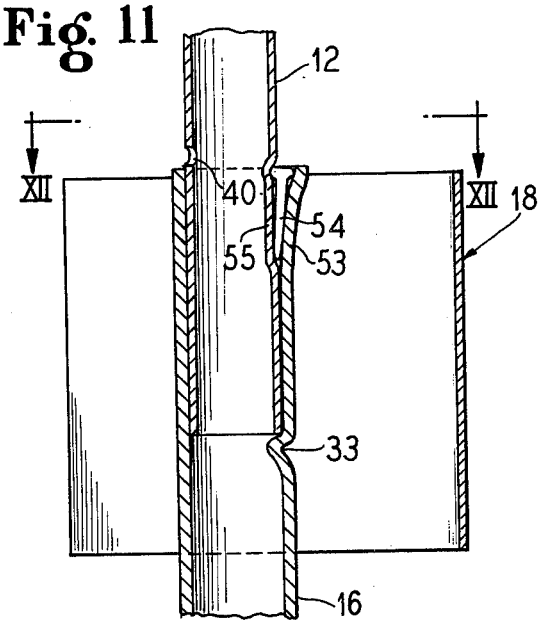
FIG. 11 is a fragmentary longitudinal sectional view of a modified wedge arrangment.
Figure 12:
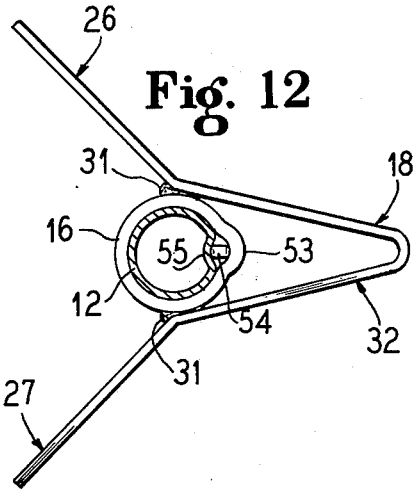
FIG. 12 is a transverse sectional view with parts in top plan taken along the lines XII—XII of FIG. 11.

In another alternate arrangement, as shown in FIGS. 11 and 12, the upper end of the barrel 16 can terminate flush with the upper edge of the flukes 18 and a tapered bulge 53 can be formed in this upper end to receive a pointed wedge 54 which, when driven into the recess provided by the bulge will deform the tube 12 at 55 locking it securely in the barrel. The wedge 54 can be flat shaped as shown in FIG. 12 to be grasped by a pliers and retracted from its locking position so that the tube 12 can be removed from the barrel 16.

Figure 9:
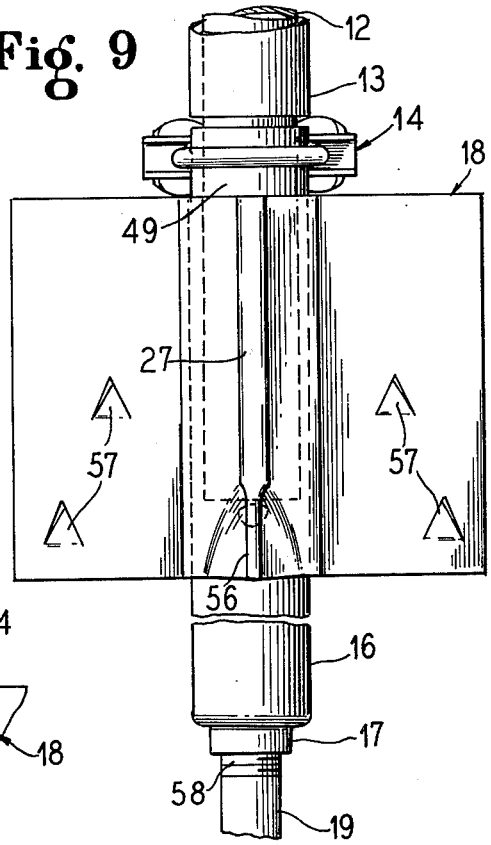
FIG. 9 is a view taken along the lines IX—IX of FIG. 8.

As shown in FIGS. 8 and 9, the legs 28 which form the fluke 32 can be pinched together at their lower ends as shown at 56 to provide a pointed driving leading edge more in conformity with the leading edges of the flukes 26 and 27. In addition, all of the flukes can be lanced to provide upturned pointed tabs or teeth 57 which will slide easily into the ground but which will resist retraction from the ground forming pockets trapping the earth. These lanced teeth 57 can be positioned at different levels across the fins.

Figure 13:
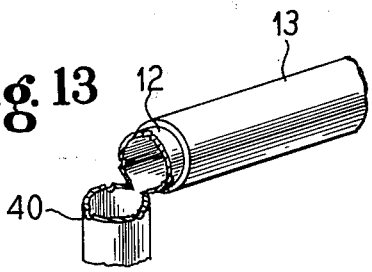
FIG. 13 is a fragmentary detailed view of a fractured stanchion tube of the assembly.

As illustrated in FIGS. 1 and 13, when the post 13 is struck by a vehicle, the stanchion tube 12 will fracture at the level of the hole 40 and will bend in the area opposite the hole to lay the post 13 flat on the ground. The fracture is sufficient so that the post will not spring back after the vehicle has passed thereover nor will it fly loose because the bending area will not sever.

As shown in FIG. 9, the extension tube 19 projecting from the barrel 16, instead of being slidably mounted in the reduced leading end 17 of the barrel, may be provided with a threaded end 58 threaded into the reduced end 17 of the barrel. In this arrangement, the extension tube 19 is driven into the ground with the barrel 16 and forms the driving end of the anchor.

In a preferred embodiment of the invention, especially suitable for roadside delineator posts carrying reflectors at their upper ends, the barrel 16 of the anchor 11 is a 12-gauge steel tube, about 1-½ inches in diameter and about 18 inches long. The extension tube 19 is also composed of steel of the same gauge and may be as long as desired to increase the stability of the anchor in the ground. The extension tube has a diameter size to slidably fit or be threaded in the reduced end 17 of the barrel and this reduced end can have an inside diameter of ¾ to 1 inch. The fins are formed from a strip of 12-gauge steel, 5 inches wide and 12 inches long which, when bent, as shown in the drawings to provide the flukes or fins will have fins radiating from the barrel in about 120° spaced relation and each about 2-⅝ inches long. The break-away or stanchion tube 12 is also composed of steel of a lesser gauge than the barrel 16. A thickness of about 0.061 is satisfactory with a diameter size for a sliding fit in the barrel 16. The tube 12 is initially about 2½ feet long to project into the plastic tube 13 about one-half of the length of this tube. The plastic tube 13 is composed of plastic material with an elastic memory such as a polyethylene plastic and is about 4 to 5 feet long with a thickness of about 0.17 inches and has an external diameter of about 1.9 inches.

The reflector tape 15 at the top end of the plastic tube 13 may be replaced with a reflector button clamped or bolted to the upper end of the tube and facing in the direction of oncoming traffic.

From the above descriptions, it should therefore be understood that this invention provides a yielding structural support system for posts which includes a finned ground anchor which is easily driven into the ground, a break-away tube having a lower end telescoped into the ground anchor and an upper end receiving a hollow post such as a plastic tube thereover. Clamping means are provided to lock the break-away tube to the ground anchor and to lock the post to the break-away tube. A fracture area is formed in the tube at ground level permitting the tube to break and bend over when the post is impacted without, however, releasing the post or causing it to spring back to an upright position. The post itself is preferably formed of a plastic material with an elastic memory and even if it is dented or bent by an impact blow, it will soon reclaim its original shape.

All of the components of the system are reusable after the post has been knocked down from an impact by discarding the end of the break-away tube below the fracture zone, reinserting the remaining portion of the break-away tube into the ground anchor and forming a new fracture zone in the break-away tube at ground level by piercing the same. Although the remaining length of the break-away tube will be shorter than the original length, it will still project into the post a sufficient distance for firmly supporting the post in an upright position,.

The system of this invention utilizes inexpensive easily mounted components all of which are reusable to reinstall a broken post assembly at the mounting site.

I claim as my invention:

1. A reusable yielding ground anchored post assembly which comprises a ground anchor having a tubular barrel with a reduced leading driving end and a plurality of radial fins on the trailing end thereof together with an internal abutment adjacent the driving end adapted to be impacted by a driving tool for forcing the anchor into the ground to a depth for submerging the fins on the trailing end, a reusable break-away tube having a lower end telescoped in the upper end of said barrel and an upper end projecting from the barrel, a post telescoped over the upper end of said break-away tube, releasable first means selectively locking the break-away tube to the barrel, releasable second means selectively locking the post to the break-away tube, said break-away tube having a fracture zone adjacent the upper end of the barrel to accommodate swinging of the post from an upright position to a horizontal position on the ground when the post receives an impact blow sufficient to fracture said tube, said breakaway tube having a nondeforming removable fitting relation with said barrel and post, said first and second means being releasable to permit easy removal of the break-away tube from said barrel and post after fracture of said tube, said tube having a reusable length remaining after fracture for relocking in said barrel and post by said first and second means, and said reusable length of said tube adapted to be weakened between said barrel and post to provide a fracture zone.

2. A ground anchor which comprises a tubular barrel having a reduced leading driving end, an impact shoulder adjacent said driving end adapted to receive a driving ram thereagainst, a metal strip bent to embrace the upper end of said barrel to form three fins radiating from the barrel in 120° spaced relation, and weld bonds uniting said strip to the barrel.

3. A ground anchor assembly which comprises a tubular barrel adapted to be driven upright into the ground, upright flukes radiating from the upper end of said barrel adapted to be submerged in the ground with the barrel, a stanchion tube having a lower end telescoped in the upper end of the barrel and an upper end projecting substantially above the flukes, a post telescoped over the upper end of the stanchion tube, separate first means clamping the lower end of the stanchion tube in the upper end of the barrel, separate second means clamping the lower end of the post on the upper end of the stanchion tube, said separate first and second clamping means being releasable to accommodate removal of the stanchion tube from the barrel and removal of the post from the stanchion tube, and visual indicator means carried on the upper end of said post.

4. The assembly of claim 1 including means limiting the depth of penetration of the break-away tube in the barrel.

5. The assembly of claim 1 wherein the break-away tube is composed of thinner gauge metal than the barrel.

6. The assembly of claim 1 wherein the post is composed of plastic material.

7. The assembly of claim 6 wherein the plastic material has an elastic memory.

8. The assembly of claim 1 wherein the first and second means are releasable to permit removal of the break-away tube from the barrel and removal of the post from the break-away tube.

9. The ground anchor of claim 2 wherein the metal strip is creased midway of its length, has diverging legs extending from the crease embracing the barrel and out-turned end portions on said legs cooperating with the legs to provide the three fins.

10. The anchor of claim 9 wherein the barrel has a longitudinal slot in its upper end, a wedge is positioned between said legs engaging the creased portion of the strip and projecting through said slot, and a tube is telescoped in the barrel and deformed into locked engagement therewith by said wedge.

11. The ground anchor of claim 10 wherein said wedge is a strip of metal spanning the space between the creased portion of strip and the interior of said barrel and has a tapered end engaging said creased portion to force the opposite end of the wedge into the barrel.

12. The ground anchor of claim 2 wherein the barrel projects above the fins, and the projecting portion has a longitudinal slot adapted to be closed by a surrounding clamp.

13. The ground anchor of claim 2 wherein the driving end of the barrel is hollow and an extension tube is supported in said driving end.

14. The ground anchor of claim 13 wherein the extension tube is slidably mounted in the hollow driving end.

15. The ground anchor of claim 14 wherein the extension tube is threaded in said hollow end of the barrel.

16. The ground anchor of claim 3 wherein one of said first and second means is a U-bolt with a bracket receiving the legs of the bolt and nuts on the legs have flanged collars with the flanges engaging the bracket in one position to tighten the bolt and straddling the bracket in a second position to loosen the bolt.

17. The ground anchor of claim 3 wherein one of said first and second means is a wedge deforming the tube or post.

18. The ground anchor of claim 3 wherein the stanchion tube has at least one side pierced by a hole to form a fracture zone at ground level.

19. The ground anchor of claim 3 wherein the barrel and flukes are metal, the stanchion tube is lighter gauge metal than the barrel, and the post is plastic material.

20. The ground anchor of claim 19 wherein the first means deforms the plastic post.

* * * * *